US005873466A

United States Patent [19]

Hulick

[11] Patent Number: 5,873,466

[45] Date of Patent: Feb. 23, 1999

[54] BLISTER PACKAGE WITH STORAGE STRIP

[75] Inventor: Martin E. Hulick, Warrington, Pa.

[73] Assignee: Sharp Corporation, Inc., Conshohocken, Pa.

[21] Appl. No.: 788,407

[22] Filed: Jan. 27, 1997

[51] Int. Cl.[6] ..... B65D 83/04

[52] U.S. Cl. ..... 206/531; 206/469; 206/470; 206/532; 206/538

[58] Field of Search ..... 206/528, 531, 206/532, 538, 539, 469, 470

[56] References Cited

U.S. PATENT DOCUMENTS

| | | | |
|---|---|---|---|
| Re. 29,705 | 7/1978 | Compere | 206/531 |
| 3,063,557 | 11/1962 | Scholl | 206/469 |
| 3,905,479 | 9/1975 | Gerner et al. | 206/531 |
| 3,912,082 | 10/1975 | Gerner et al. | 206/531 |
| 3,924,747 | 12/1975 | Gerner | 206/531 |
| 4,243,144 | 1/1981 | Margulies | 206/532 |
| 4,537,312 | 8/1985 | Intini | 206/531 |
| 4,884,693 | 12/1989 | Brutsch | 206/470 |
| 5,172,812 | 12/1992 | Wharton et al. | 206/531 |
| 5,310,060 | 5/1994 | Bitner et al. | 206/532 |
| 5,339,960 | 8/1994 | Price | 206/531 |

*Primary Examiner*—Bryon P. Gehman
*Attorney, Agent, or Firm*—Woodcock Washburn Kurtz Mackiewicz & Norris, LLP

[57] ABSTRACT

A package for dispensing a medicament and storing an unused portion of the medicament is provided. The package comprises an upper sheet defining a plurality of whole medicament blisters for containing whole medicaments therein. The upper sheet further defines a storage blister for storing the unused portion of the medicament therein. A storage strip is movably coupled proximate the storage blister to contain the unused portion of the medicament within the storage blister for later use.

11 Claims, 2 Drawing Sheets

BLISTER PACKAGE WITH STORAGE STRIP

FIELD OF THE INVENTION

The present invention relates generally to blister packages for continuing medicaments, tablets, and the like, and more particularly to blister packages that dispense a whole medicament and then store an unused portion of the medicament for later use.

BACKGROUND OF THE INVENTION

Blister packages for containing three dimensional items are well known in the art. Blister packages typically comprise a plastic upper blister sheet for storing a product and a lower tearable-foil sheet for containing the product within the blister. Additionally, the lower tearable-foil sheet is torn to enable the product to be dispensed from the blister. The upper blister sheet and lower tearable-foil sheet may be hermetically sealed together to enclose various dosages of aspirin tablets, vitamin tablets, other medicaments, and the like. Traditional blister packages, however, have several drawbacks.

One drawback with traditional blister packages is that the package may contain a higher dosage than is required for a user and, therefore, the unused portion of the medicament or tablet may be discarded. It would, therefore, be desirable to provide a package that enables a user to store a remaining portion of a tablet for later use.

SUMMARY OF THE INVENTION

A package for dispensing a whole medicament and storing an unused portion of the medicament is provided. The package comprises at least one blister adapted for storing and dispensing the whole medicament and storing and dispensing the unused portion of the medicament. A storage strip is movably coupled to at least one blister. The storage strip is adapted to move from a first position to a second position. The storage strip is adapted to contain the unused portion of the medicament within the blister for later use at the second position and move to an intermediate position between the first and second positions to dispense the unused portion of the medicament from the blister.

DETAILED DESCRIPTION OF THE PREFERRED EMBODIMENT

Figure 1:
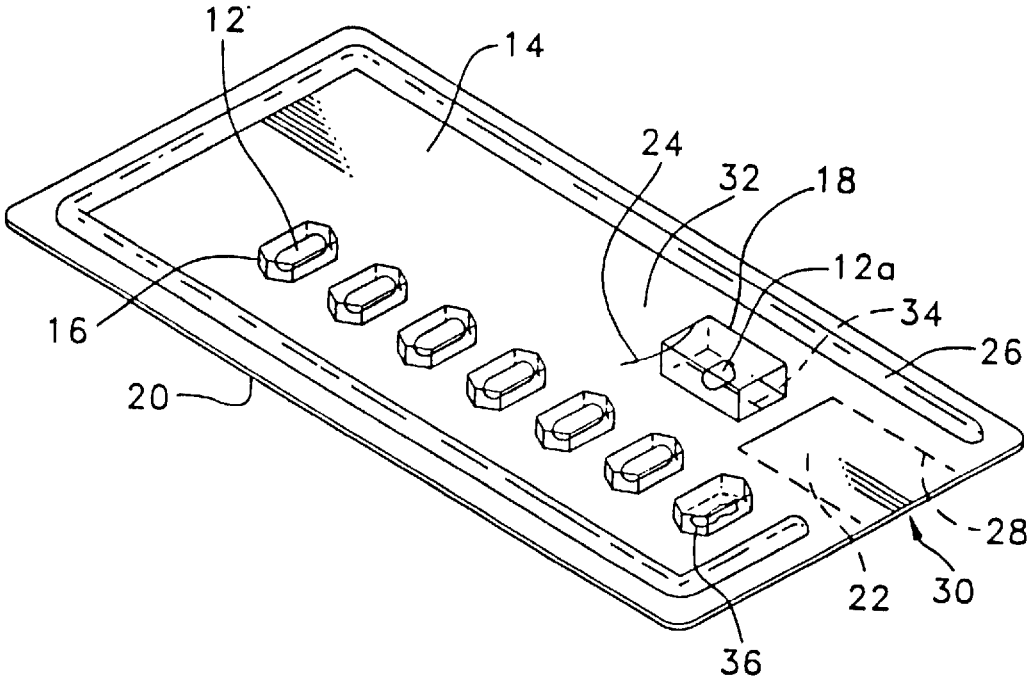
FIG. 1 is a perspective view of a blister package according to the present invention for dispensing a whole medicament and storing an unused portion of the medicament for later use.

FIG. 1 shows the preferred embodiment of a blister package 10 for containing and dispensing a whole medicament 12 and storing and dispensing an unused portion of the medicament 12*a* for later use. The package 10 comprises an upper sheet 14, a plurality of whole medicament blisters 16, a storage blister 18, a stiffening rib 26, a lower sheet 20, a storage strip 22, and a snap cut 24. Six whole medicaments 12 are shown contained within six individual whole medicament blisters 16 and one unused portion of a medicament 12*a* is shown stored in the storage blister 18.

The upper sheet 14 defines the whole medicament blisters 16, storage blister 18, and stiffening rib 26. The whole medicament blister 16 and storage blister 18 each have a compartment 19 for containing each respective product. Each whole medicament blister 16 defines a dispensing opening 36. The storage blister 18 defines a receiving opening 34. Preferably, the upper sheet is made of a flexible plastic material so that the whole medicament blisters 16, storage blister 18 and stiffening rib 26 can be relatively easily formed in the upper sheet 14. The whole medicament blisters 16 and storage blister 18 may be formed in almost any shape and size to contain any medicament or like product.

The stiffening rib 26 is formed around substantially the entire periphery of the upper sheet 14 to prevent the blister package 10 from curling. The stiffening rib 26 ends proximate the storage strip 22. If necessary, however, the stiffening rib 26 may extend onto the storage strip 22 so long as the storage strip 22 is adapted to move as described below. Any number of stiffening ribs may be formed at any location in the upper sheet 14 to prevent the blister package from curling.

The lower sheet 20 is positioned proximate each dispensing opening 36 such that the whole medicaments 12 are contained within each of the whole medicament blisters 16. Preferably, the lower sheet 20 is hermetically coupled below the whole medicament blisters 16 such that the lower sheet 20 can be manipulated to expose each dispensing opening 36 to dispense a medicament 12 from a particular blister 16. Preferably, the lower sheet 20 is made of a flexible tearable foil material so that the foil can be torn to expose the dispensing opening 36. It is noted that additional sheets of material may be provided over the foil material 20 for child-resistance, aesthetic or labeling purposes. Methods for hermetically coupling the lower sheet 20 below the blisters 16 are well known by those skilled in the art. The lower sheet 20 is discussed in more detail below.

The storage strip 22 is movably coupled with the upper sheet 14 and lower sheet 20 proximate the storage blister 18 and snap cut 24. Preferably, the storage strip 22 is defined by two parallel detachable score lines 28 that extend through both the upper sheet 14 and lower sheet 20. The score lines 28 are detachable to enable the storage strip 22 to move from a first position 30 to a second position 32. When the storage strip 22 is in the second position 32, the storage strip 22 removably engages the snap cut 24 and covers the receiving opening 34 below the storage blister 18 to contain the unused portion 12*a* of a medicament therein.

The storage strip 22 may be formed in almost any shape so long as it can engage the snap cut 24. Preferably, the storage strip 22 has a rectangular shape to engage an arc-shaped snap cut 24. It is noted that the storage strip 22 may be formed to completely detach from the upper sheet 14 and lower sheet 20 or be provided as a separate member from the package 10 when additional snap cuts 24 or another type of securing member is provided to movably secure the storage strip 22 beneath the receiving opening 34. Additionally, the storage strip 22 can be positioned proximate the receiving opening 34 to partially cover the receiving opening 34 to contain the unused portion of the medicament within the storage blister 18.

It is noted that although seven whole blisters 16 are shown, any number of whole medicament blisters 16 having various shapes may be provided to contain any number of medicaments and the like. In an alternative embodiment, a single whole medicament blister 16 may be provided to store one or more whole medicaments 12 and also store an unused portion or portions of a medicament 12*a* therein. In this alternative embodiment, the lower sheet 20 is adapted to form at least one opening for dispensing a whole medicament 12 and receive the unused portion 12*a* of the medicament. The storage strip 22 and snap cut 24 may be formed in any of the manners discussed above.

Figure 2:
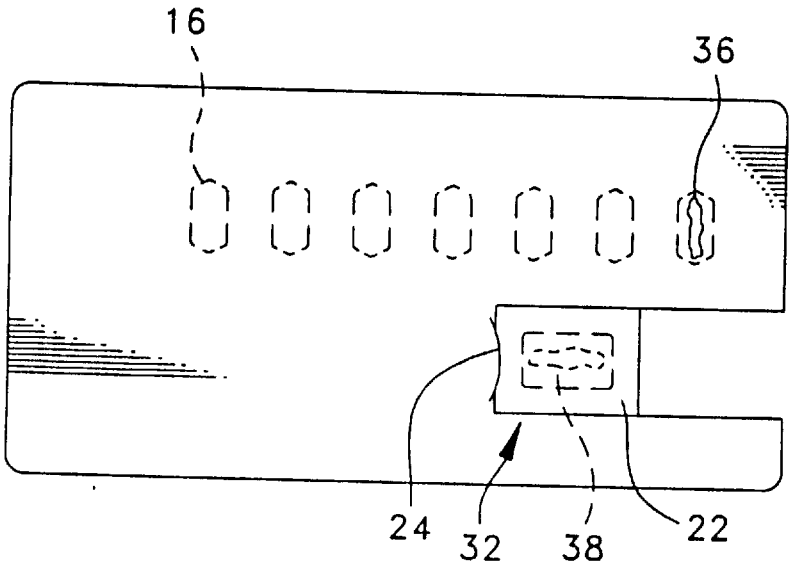
FIG. 2 is a bottom view of the package shown in FIG. 1.

FIG. 2 is a bottom view of the package 10 and shows the lower sheet 20 in more detail. The lower sheet 20 is positioned such that a whole medicament 12 is contained within the whole medicament blisters 16. The lower sheet 20 is adapted to expose the dispensing openings 36 to release the whole medicament from the whole medicament blister 16. The lower sheet can define perforation or score lines that are detachable to expose openings 36. Preferably, the lower sheet 20 is a flexible tearable foil so that no perforation or score line need be formed proximate the whole medicament blisters 16.

In contrast, preferably a perforated tear line 38 is formed in the lower sheet 20 proximate the receiving opening 34 of the storage blister. The tear line 38 is detached to expose the receiving opening 34 to receive and dispense the unused portion of the medicament 12*a* from the storage blister 18. The receiving opening 34 is positioned such that when the storage strip moves to the second position and engages the snap cut 24, the unused portion of the medicament is contained within the storage blister 18. It is noted that the perforated tear line 38 is not critical so long as the lower sheet 20 can be manipulated to expose the opening 34 or the opening 34 remains exposed after manufacturing.

Figure 3:
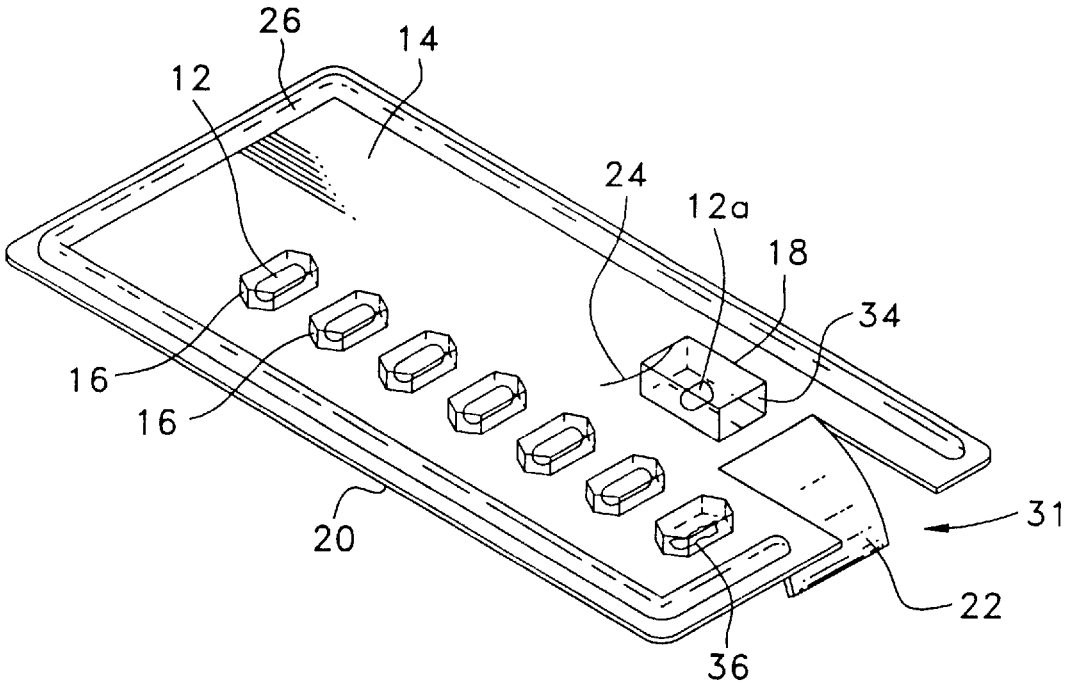
FIG. 3 is an illustration of the storage strip at an intermediate position such that the unused portion of the medicament may be removed from the storage blister.

FIG. 3 shows the storage strip 22 in a position intermediate 31 the first position 30 and second position 32. With the storage strip 22 in the intermediate position 31, the unused portion 12*a* of the medicament can be dispensed from the storage blister 18.

In operation, the lower sheet 20 is torn to form the dispensing opening 36 to dispense the whole medicament 12 from the whole medicament blister 16. Next, the unused portion of the medicament 12*a* is prepared to be stored in the storage blister 18. The score lines 28 are detached to enable the storage strip 22 to move from the first position 30 to the second position 32. The perforated lines 38 are detached to form the receiving opening 34 beneath the storage blister 18. The unused portion of the medicament is placed through the receiving opening 34 and into the storage blister 18. The storage strip 22 is moved to the second position 32 and engages the snap cut 24 to contain the unused portion 12*a* of the medicament within the storage blister 18. The storage strip 22 is moved to the intermediate position 31 to dispense the unused medicament from the storage blister 18.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A medicament package comprising:

at least one first compartment adapted to store and dispense a medicament and being unsuitable for restoring the medicament therein once the medicament has been dispensed therefrom;

a second compartment comprising a storage blister and adapted to re-usably receive, store and dispense an unused portion of the medicament that has been dispensed from the at least one first compartment;

a layer of packaging material applied to an underside of said package and being deformable to form openings into said first and second compartments;

a storage strip defined, at least in part, by a tear line formed in said layer of packaging material and being movable between a first position and a second position adjacent said storage blister, said storage blister being adapted to (i) store the unused portion of the medicament when said storage strip is in the first position and (ii) receive and dispense the unused portion of the medicament when said storage strip is in said second position.

2. The medicament package of claim 1, wherein said layer of packaging material comprises a layer of tearable foil.

3. The medicament package of claim 1, wherein said storage blister is made of a plastic material.

4. The medicament package of claim 1 further comprising a snap cut in said layer of packaging material and wherein said storage strip engages the snap cut when in said second position.

5. The medicament package of claim 1 wherein said storage strip has a rectangular shape and said snap cut has an arc shape.

6. A medicament package comprising:

a plurality of first compartments each for storing a single medicament and each being adapted to dispense the medicament stored therein and being unsuitable for restoring the medicament therein once the medicament has been dispensed therefrom;

a second compartment comprising a storage blister and adapted to re-usably receive, store and dispense an unused portion of one of the medicaments that has been dispensed from one of the first compartments;

a layer of packaging material applied to an underside of said package and being deformable to form openings into said first and second compartments;

a storage strip defined, at least in part, by a tear line formed in said layer of packaging material and being movable between a first position and a second position adjacent said storage blister, said storage blister being adapted to (i) store the unused portion of the medicament when said storage strip is in the first position and (ii) receive and dispense the unused portion of the medicament when said storage strip is in said second position.

7. The medicament package of claim 6, wherein said storage strip closes an opening into said storage blister when in said first position and reveals an opening into said storage blister when in said second position.

8. The medicament package of claim 6, wherein said layer of packaging material comprises a layer of tearable foil.

9. The medicament package of claim 6, wherein said storage blister is made of a plastic material.

10. The medicament package of claim 6 further comprising a snap cut in said layer of packaging material and wherein said storage strip engages the snap cut when in said second position.

11. The medicament package of claim 6 wherein said storage strip has a rectangular shape and said snap cut has an arc shape.

* * * * *